United States Patent [19]

Stroud

[11] Patent Number: 4,854,405

[45] Date of Patent: Aug. 8, 1989

[54] CUTTING TOOLS

[75] Inventor: Donald S. Stroud, Houston, Tex.

[73] Assignee: American National Carbide Company, Tomball, Tex.

[21] Appl. No.: 140,539

[22] Filed: Jan. 4, 1988

[51] Int. Cl.[4] ..... F21B 10/52

[52] U.S. Cl. ..... 175/374; 175/410

[58] Field of Search ..... 175/374, 409, 410, 411; 76/108 A, DIG. 11; 75/240, 242

[56] References Cited

U.S. PATENT DOCUMENTS

| | | | |
|---|---|---|---|
| Re. 19,182 | 5/1934 | Emmons | 77/70 |
| 1,977,845 | 10/1934 | Emmons | 76/108 |
| 2,842,342 | 7/1958 | Haglund | 255/63 |
| 2,858,718 | 11/1958 | Kohler | 77/70 |
| 2,888,247 | 5/1959 | Haglund | 255/63 |
| 2,889,138 | 6/1959 | Haglund | 255/64 |
| 3,017,790 | 1/1962 | Werle | 77/70 |
| 3,080,009 | 3/1963 | Baker | 175/410 |
| 3,311,181 | 3/1967 | Fowler | 175/410 |
| 3,693,736 | 9/1972 | Gardner | 175/410 |
| 3,984,910 | 10/1976 | Helton et al. | 29/420 |
| 4,143,723 | 3/1979 | Schmotzer | 175/410 |
| 4,339,009 | 7/1982 | Busby | 175/374 |
| 4,372,404 | 2/1983 | Drake | 175/374 |
| 4,452,325 | 6/1984 | Radd et al. | 175/410 |
| 4,484,644 | 11/1984 | Cook et al. | 175/410 |
| 4,722,405 | 2/1988 | Langford, Jr. | 175/410 X |

FOREIGN PATENT DOCUMENTS

| | | | |
|---|---|---|---|
| 2801675 | 7/1979 | Fed. Rep. of Germany | 175/410 |
| 848565 | 7/1981 | U.S.S.R. | 175/410 |

*Primary Examiner*—Stephen J. Novosad
*Assistant Examiner*—David J. Bagnell
*Attorney, Agent, or Firm*—Vaden, Eickenroht, Thompson & Boulware

[57] ABSTRACT

There are disclosed two embodiments of a hard metal insert adapted to be installed on the face of a cutting tool, each insert comprising inner and outer bodies having particles of carbide or other highly abrasive material sintered in a binder of cobalt or other less abrasive, but tougher metal, and having wear surfaces of their outer ends configured to form a tip on the outer end of the inner body, and wherein the particle size and/or chemical composition of the bodies are such that the inner body is harder, but less tough, than the outer body.

3 Claims, 3 Drawing Sheets

FIG. 3
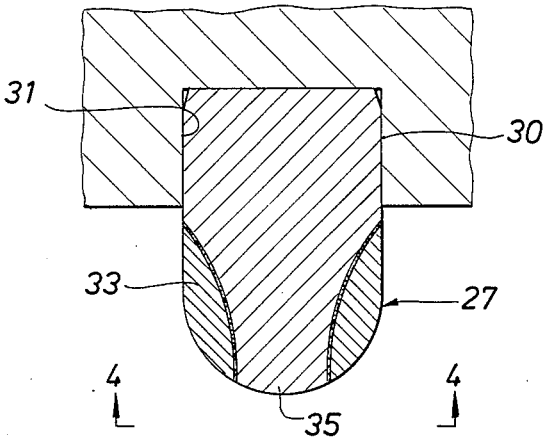
FIG. 5
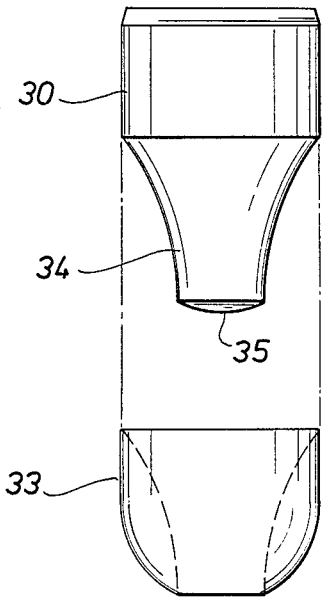
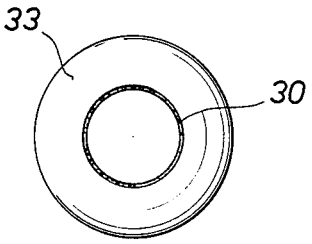
FIG. 4
FIG. 6
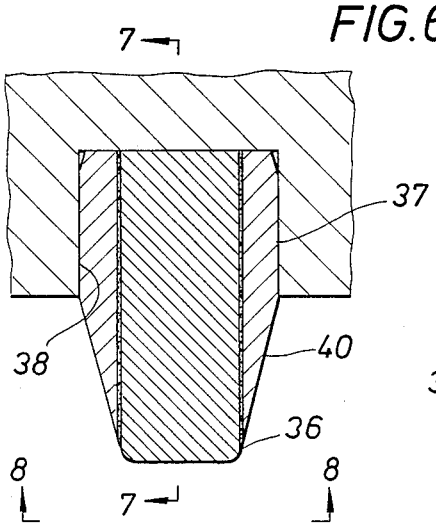
FIG. 7
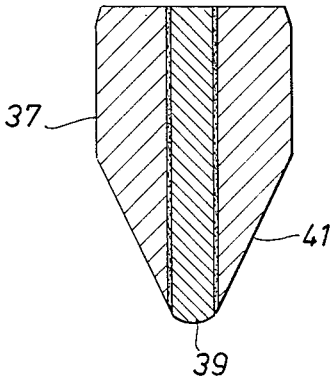
FIG. 9
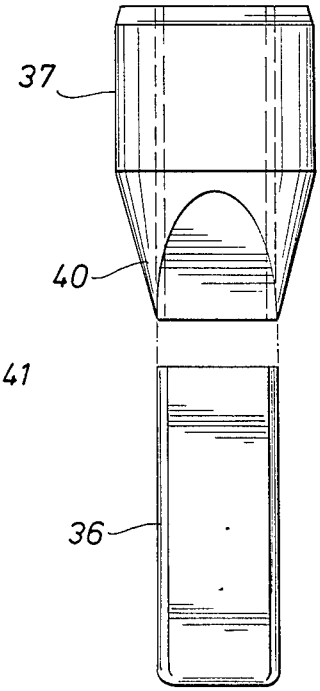
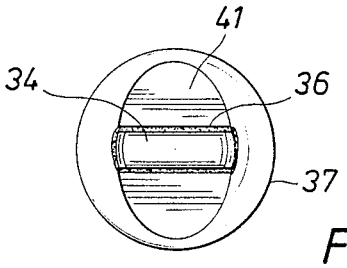
FIG. 8

FIG. 10
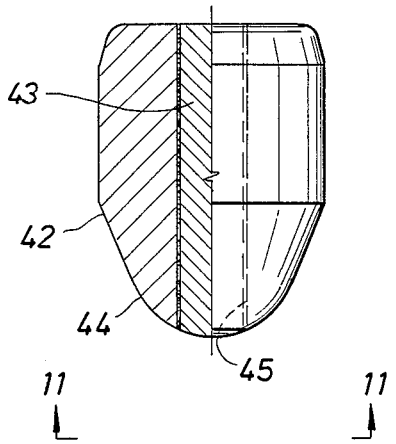
FIG. 13
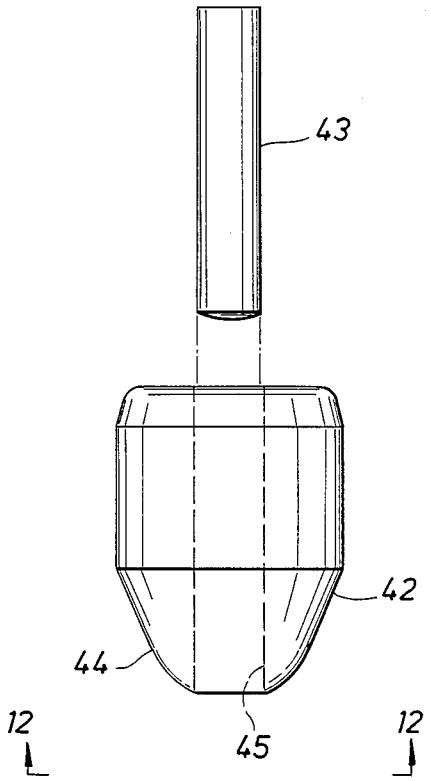
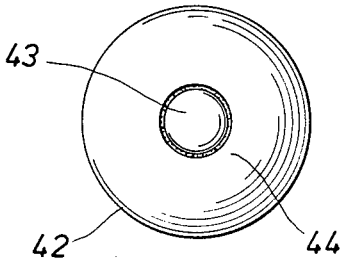
FIG. 11
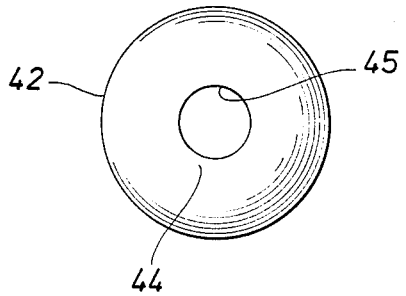
FIG. 12

CUTTING TOOLS

This invention relates generally to cutting tools for use in the drilling, mining and construction industries. More particularly, it relates to improvements in wear resistant inserts which are adapted to be installed on the face of such a cutting tool and which are formed of particles of carbide or other highly abrasive material sintered in a binder of cobalt or other less abrasive, but tougher metal.

In the drilling of oil and gas wells, drill bits are installed at the lower end of a rotary drill string for cutting through rock and other hard formations. These bits, which may, for example, be of a tri-cone or a percussion type, have inserts of wear resistant material installed on the cutting faces of the bit by press fit or by being cemented in place such that their outer ends project from the face of the bit body to provide the wear surfaces of the bit.

The inserts are available in different "grades" depending on the particle sizes and/or chemical composition, whereby the user is able to choose between relatively hard, but more brittle, or less hard, but tougher, inserts. The wear surfaces on the outer ends of the inserts are so contoured to define a tip. These surfaces may be rounded or conical with the ti located in the center of the outer end of the insert, or, depending on the use to which the bit is to be put, may be flat along opposite sides of a tip which extends laterally across its outer end.

As the insert is worn, the tip forms flats which dull the wear surfaces of the insert. As a result, the cutting rate of the insert is reduced and/or it may be necessary to prematurely remove the bit to permit the inserts to be replaced or resharpened. It is therefore an object of this invention to provide an insert of this type which is of such construction that there is less tendency for it to become dull as it wears such that it has maximum cutting rate throughout its life and need not be replaced or sharpened.

Although it is desirable to make the inserts of hard material in order to increase their cutting rate, their resulting brittleness may require that they be shorter than desired. Another object is to provide an insert of such construction that it has a high drilling rate, but is nevertheless of substantial length and strength so as to extend its life.

These and other objects are accomplished, in accordance with the illustrated embodiments of the invention, by an insert which comprises inner and outer bodies having wear surfaces which are contoured to define the tip at the outer end of the inner body, and which are of different grades in that their particle sizes and/or chemical compositions are such that the inner body is harder, but less tough, than the outer body. As a result, the outer body, which is subject to less wear, wears at a greater rate than the inner body so that the original contour of their wear surfaces is maintained as they wear, and hence the wear surfaces do not tend to dull. Thus, there is less likelihood that the inserts would have to be replaced or resharpened. Furthermore, since the inner body of harder material is surrounded by the outer body of tougher material, which acts as a buffer or support for the inner body, the insert may be longer and the inner body may be made of a harder than ordinary material with little risk or concern about breakage. More particularly, the bodies are sintered separately of one another, such that there is no risk of migration of cobalt from one to the other, despite wide variations in sintering temperature when the bodies are of widely varying grades, and then brazed to one another by a thin layer of brazing material whose brazing temperature is less than the sintering temperature of either body.

IN THE DRAWINGS

FIG. 3 is a longitudinal sectional view of a button-type insert constructed in accordance with one embodiment of the present invention;

FIG. 4 is an end view of the insert, as seen along broken lines 4—4 of FIG. 3;

FIG. 5 is an elevational view of the inner and outer bodies of the insert following sintering, but prior to assembly for brazing to one another;

FIG. 6 is a longitudinal sectional view of a chisel-type insert constructed in accordance with another embodiment of the present invention;

FIG. 7 is a longitudinal sectional view of the insert of FIG. 6 as seen along broken lines 7—7 of FIG. 6;

FIG. 8 is an end view of the insert as seen along broken lines 8—8 of FIG. 6;

FIG. 9 is an elevational view of the inner and outer bodies of the insert, following sintering, but prior to assembly for brazing.

FIG. 10 is a longitudinal sectional view of another embodiment of an insert constructed in accordance with the present invention;

FIG. 11 is a bottom view of the insert of FIG. 10;

FIG. 12 is a top view of the insert of FIG. 10; and

FIG. 13 is an elevational view of the inner and outer bodies of the insert prior to assembly for brazing.

Figure 1:
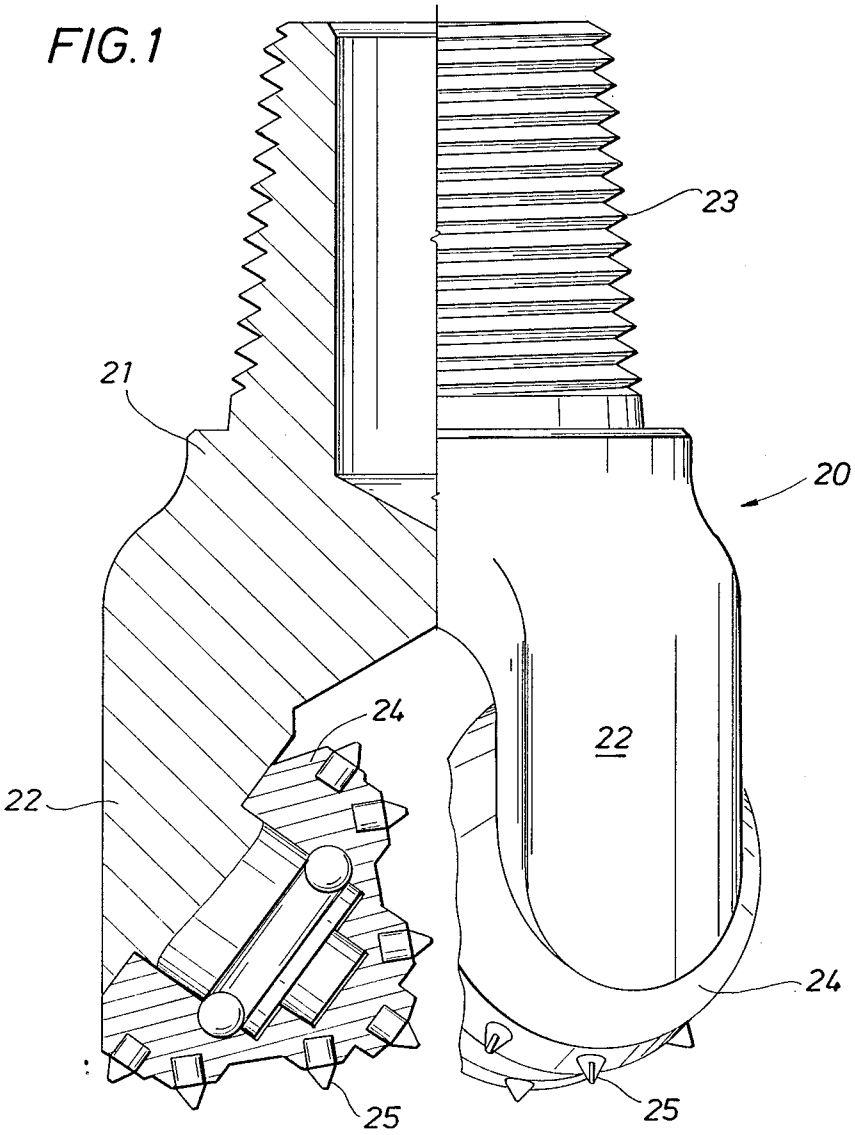
FIG. 1 is a view partly in elevation and party in section of a tri-cone rotary drill bit having chisel-type inserts on the cutting faces of the cone, and showing the inner ends of the inserts held within holes in the cone face.

With reference now to details in the above-described drawings, the bit 20 shown in FIG. 1 comprises a bit body 21 having threads 23 at its upper end for connection to the lower end of a rotary drill string and legs 22 extending from its lower end. The legs support three roller cones 24 arranged in equally spaced relation for rotation about their axes as they rotate with the bit body. As shown in a broken away portion of FIG. 1, rows of chisel-type inserts 25 are installed on the cutting face of each cone with the inner end of each insert press fitted within a hole in the cone to dispose its outer end in position to cut away the bottom of the wellbore as the bit is rotated with the drill string, and tips across their outer ends extending in a direction generally transverse to the direction of rotation of the bit body.

Figure 2:
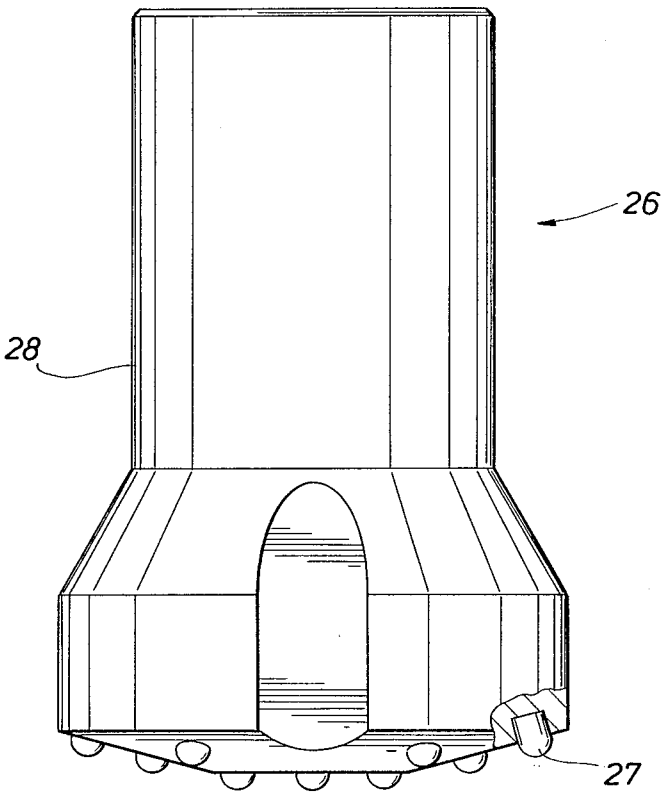
FIG. 2 is an elevational view of a percussion-type rotary drill bit having button-type inserts installed on the face of the bit body.

In the percussion-type bit 26 shown in FIG. 2, button-type inserts 27 are installed on the face of the lower end of the bit body 28, as by press-fitting within holes in the lower end of the bit body, as shown in a sectional portion of FIG. 1. The inserts 27 differ from the inserts 25 in that their tips are located centrally of their outer ends so that they need not be rotationally oriented within the holes in the bit body.

As shown in FIGS. 3 to 5, each button-type insert 27 includes an elongate inner body 30 having a cylindrical inner end adapted to be press fitted within a hole 31 in the face of the lower end of the percussion bit body, and an outer body 33 adopted to fit closely about a reduced portion 34 of the outer end of the body 30. More particularly, the reduced portion of the inner body is gently curved toward its outer end, and the outer body is of generally funnel shape having a curved inner surface for fitting closely over reduced portion 34 and an outer cylindrical surface forming a continuation of the cylindrical surface of the inner end of the body. More particularly, the outer ends of the inner and outer bodies are curved convexly about a center point on the longitudinal axis of the insert to form a wear surface including a tip 35 on the end of the inner body arranged concentrically within the outer body.

As shown in FIGS. 6 to 9, the chisel-type insert 25 also includes an elongate inner body 36 and an outer body 37 adapted to fit closely about the inner body. The inner body is of rectangular cross-sections and extend from one end to the other of the insert. The outer diameter of the inner end of the outer body is cylindrical to fit within a hole 38 in the cutting face of the bit and thus installed thereon by shrink fitting. The inner end of the inner body projects beyond the inner end of the outer body to form a tip 39 across its outer end, and the outer ends of the wear surfaces 40 and 41 of the outer bodies are tapered toward the tip.

The bit insert 42 shown in FIGS. 10 to 13 is especially well adapted for installation on the face of the cones of a tri-cone bit, as shown in FIG. 1. The insert includes an outer body 43 having an outer cylindrical wall on its inner end adapted to be press fitted into a hole in a bit cone and surrounding an inner body 44. The inner body extends through the outer body from one end of the insert to the other to form a tip 45 on its outer end centrally of the insert, as in the insert 27. However, as compared with insert 27, inner body 44 is of cylindrical shape for fitting closely within a cylindrical hole through outer body 43, and the outer side of the outer end of body 43 is of conical shape.

As previously described, each of the bodies of each insert if formed of particles of carbide or other highly abrasive materials intered within cobalt or other less abrasive, but tougher metals. Thus, for example, the particles may be titanium carbide or molybdenum carbide, and the binder may be cobalt or a binding metal from the iron group, as well known in the art. As also previously described, inserts of this type are assigned grades depending on the size of the particles and/or chemical composition—i.e., the relative proportions of carbide and binder. Thus, for example, a grade of insert having smaller particles and less cobalt has higher wear resistance, but is less brittle.

As also previously discussed, the tip of each insert tends to wear more than the surrounding surfaces so that insert of conventional construction become dull. In accordance with the present invention, however, the aforementioned bodies are of different grades with the particle sizes and/or chemical composition of the bodies being such that the inner body is harder and thus more wear resistant, but less tough, than the outer body. Thus, although the tip and surrounding wear surfaces of the inner body receive greater wear than the wear surfaces of the outer body, their greater resistance to wear will tend to preserve the original contour of the overall wear surfaces of the insert during wear.

Due to their different chemical compositions, the bodies of different grades must be sintered at different temperatures, depending on the percentage of cobalt by weight in each. Hence, when the grades of the two bodies are widely divergent, as in the case of the inserts of the present invention, there might be objectionable migration of cobalt from one body to the other if they were to be sintered together at the higher temperature necessary to form the other body. In accordance with the present invention, however, the bodies are separately sintered, and then assembled one within the other to arrange their wear surfaces as shown. When so assembled, the adjacent surfaces of the bodies are brazed to one another at a brazing temperature less than the sintering temperature of the binder of either body. So, there is no damage due to cobalt migration of either of the sintered bodies as they are joined. A suitable brazing material may be chosen from a large group such as copper, silver, bronze, or brass, each of which has a brazing temperature less than the melting point of cobalt or other binder.

It will be understood that the construction of the inserts above-described, are merely illustrative, and that the other constructions having other wear surface configurations are also anticipated by the present invention.

From the foregoing it will be seen that this invention is one well adopted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a drill bit having at least one roller with hard metal inserts having inner ends installed within and outer ends extending from holes about the roller, each said insert comprising inner and outer bodies having particles of carbide or other highly abrasive material separately sintered in a binder of cobalt or other less abrasive, but tougher metal, and being joined to one another with the outer body surrounding the inner body, said bodies having wear surfaces on their outer tends which are contoured to define a tip on the outer end of the inner body; and the particle size and/or chemical composition of the bodies being such that the inner body is harder, but less tough, than the outer body, whereby the general contour of their wear surfaces in maintained during use.

2. A bit of the character defined in claim 1, wherein the wear surfaces of the bodies of each insert are concavely rounded to form a tip on the inner body concentrically within the outer body.

3. A bit of the character defined in claim 1, wherein the wear surfaces of the bodies of each insert include flat sides which taper toward a tip on the inner body which extends across the outer end of the insert in a direction generally transverse to the direction of rotation of the roller.

* * * * *